US012110645B2

(12) United States Patent
Alberson et al.

(10) Patent No.: US 12,110,645 B2
(45) **Date of Patent: *Oct. 8, 2024**

(54) TRAFFIC BARRIER WITH INERTIAL CRASH PANELS AND SOUND BARRIER

(71) Applicant: Vandorf SW1 Inc., Stouffville (CA)

(72) Inventors: Dean Clinton Alberson, Kerrville, TX (US); Mark Christopher Ayton, Welland (CA); Mohammed Talha Ghuman, Newmarket (CA); Benjamin Fraser Powell, King City (CA)

(73) Assignee: Vandorf SW1 Inc., Stouffville (CA)

( * ) Notice: Subject to any disclaimer, the term of this patent is extended or adjusted under 35 U.S.C. 154(b) by 832 days.

This patent is subject to a terminal disclaimer.

(21) Appl. No.: 17/204,659

(22) Filed: Mar. 17, 2021

(65) Prior Publication Data

US 2021/0292983 A1 Sep. 23, 2021

Related U.S. Application Data

(60) Provisional application No. 62/991,267, filed on Mar. 18, 2020.

(51) Int. Cl.

| | |
|---|---|
| ***E01F 8/00*** | (2006.01) |
| ***E01F 15/08*** | (2006.01) |
| ***E02D 27/42*** | (2006.01) |

(52) U.S. Cl.

CPC ..... *E01F 8/0017* (2013.01); *E01F 8/0023* (2013.01); *E01F 15/083* (2013.01); (Continued)

(58) Field of Classification Search

CPC ..... E01F 8/0011; E01F 8/0017; E01F 8/0023; E01F 15/0461; E01F 15/0476; (Continued)

(56) References Cited

U.S. PATENT DOCUMENTS 5,965,852 A * 10/1999 Roschke ..... E01F 8/0017 181/210
6,434,900 B1 * 8/2002 Masters ..... E01F 8/0023 256/73

(Continued)

FOREIGN PATENT DOCUMENTS

AT 402212 B * 1/1997 ..... E01F 15/088
DE 202012008071 U1 1/2013

(Continued)

*Primary Examiner* — Matthew R McMahon

(74) *Attorney, Agent, or Firm* — John G. Fischer, Esq.; Scheef & Stone, L.L.P.

(57) ABSTRACT

A traffic barrier and soundwall system is disclosed having wide-flanged [or h-posts] vertical posts oriented with a flange facing a roadway. Traffic barriers are located between them. The barriers have recesses at the intersection of their backs and ends. Sound panels are stacked on top of the traffic barriers. A crash panel is located between the vertical posts, above one or more sound panels. The crash panels have recesses at the intersection of their backs and ends. Additional sound panels are stacked above the crash panels. An angle bracket is located in the recess. U-shaped connectors connect the recesses of adjacent traffic barriers together around a post. U-shaped connectors connect the recesses of adjacent crash panels together around a post, and above the traffic barriers and sound panels to achieve a MASH TL-4 crash test rating.

23 Claims, 16 Drawing Sheets

(52) U.S. Cl.
CPC ..... *E01F 15/085* (2013.01); *E01F 15/088* (2013.01); *E02D 27/42* (2013.01)

(58) Field of Classification Search
CPC ..... E01F 15/083; E01F 15/085; E01F 15/088; E02D 27/42
See application file for complete search history.

(56) References Cited

U.S. PATENT DOCUMENTS

| | | | | |
|---|---|---|---|---|
| 7,220,077 | B2 * | 5/2007 | Humphries | E01F 8/0017 404/6 |
| 8,001,880 | B2 * | 8/2011 | White | F41H 5/24 404/6 |
| 8,061,926 | B2 | 11/2011 | Riddell et al. | |
| 8,561,371 | B2 * | 10/2013 | Sanders | E04B 1/14 52/764 |
| 10,221,529 | B1 | 3/2019 | Sanders et al. | |
| 10,400,402 | B1 * | 9/2019 | Sanders | E01F 8/0029 |
| 10,767,325 | B2 * | 9/2020 | Humphries | E01F 8/0023 |
| 11,578,466 | B2 * | 2/2023 | Alberson | E01F 15/083 |
| 2007/0131480 | A1 * | 6/2007 | Corbin | E01F 8/007 181/210 |
| 2014/0353565 | A1 * | 12/2014 | Ditta | E01F 15/083 256/59 |
| 2019/0211518 | A1 | 7/2019 | Humphries et al. | |

FOREIGN PATENT DOCUMENTS

| | | | | |
|---|---|---|---|---|
| JP | 5701435 | B1 | 4/2015 | |
| KR | 101374646 | B1 * | 3/2014 | E01F 8/0023 |

* cited by examiner

TRAFFIC BARRIER WITH INERTIAL CRASH PANELS AND SOUND BARRIER

RELATED APPLICATION

This application claims priority to Provisional Application 62/991,267, filed Mar. 18, 2020.

FIELD OF THE DISCLOSURE

This disclosure relates to a system that combines an impact absorbing traffic barrier system combined with a noise dampening soundwall and having a secondary impact resistant barrier in the form of an inertial crash panel suspended within the soundwall portion. The connectivity of these elements is unique to the present invention.

BACKGROUND

Current traffic barrier and soundwall systems are difficult to install, difficult and expensive to repair, and upon impact by a truck or other tall vehicle, provide inadequate resistance to movement that results in underride, override, uncontrolled deflection and unacceptable damage to the impacting vehicles. Additionally, current traffic and noise barrier systems fail to adequately protect the soundwall portion of the systems from engagement and damage caused by the top corners of truck containers. Truck container corners rip into the relatively softer soundwall material and engage with the vertical posts of the barrier system. This increases the risk to the truck driver and other vehicles as the truck may be stopped suddenly or rotated back into the lanes. Due to a truck having a higher center of gravity, there is the risk of a truck rotating over the traffic barrier and penetrate through the barrier system to the other side.

There is a need for a traffic barrier and soundwall system that is easy to install, repairable, and that incorporates a means for reducing damage to the system when engaged by a truck. There is also a need for a traffic barrier and soundwall system that does not engage and snag on a container corner when engaged by a truck, such that the truck may be undesirably rotated back into the traffic lanes. There is also a need for a traffic barrier and soundwall system that, upon impact by a truck or other vehicle, provides improved resistance to movement and thus to underride, override, uncontrolled deflection and unacceptable damage to the impacting vehicles.

There is a need for a traffic barrier and soundwall system that is easy to transport and efficiently installed. There is a need that it be aesthetically pleasing on the front side and rear side.

An advantage of the embodiments of the disclosed invention is that it provides a means for effectively connecting elevated precast concrete barriers together in a series connection around vertical posts to achieve maximum stability of the barrier system. Another advantage of the embodiments of the disclosed invention is that the vertical posts serve a second purpose of a mounting system for sound dampening or reflecting panels. Another advantage of the embodiments of the disclosed invention is that vertical posts serve a third purpose of a mounting system for elevated inertial crash panels ("crash panels"). Another advantage of the embodiments of the disclosed invention is that it provides an efficient installation means without critical alignment of threaded rods extending from the traffic barriers with holes drilled in the vertical posts.

Another advantage of the embodiments of the disclosed invention is that it provides a simple and light-weight barrier to barrier connection method that is easy to transport and install and provides the backside of the system with a uniform and uninterrupted appearance.

Another advantage of the embodiments of the disclosed invention is that it provides a continuous surface for engagement with truck container corners to prevent interference points that may engage and snag truck container corners causing the vehicle to stop forcefully or to rotate dangerously back into traffic or over the traffic barrier and penetrate through the soundwall to the other side. Another advantage of the embodiment of the disclosed invention is that it provides a traffic and noise barrier system that does not require elevated horizontal beam placement forward of the vertical posts. Such beams forward of vertical posts are now used to provide a continuous surface for engagement with truck containers.

In summary, the disclosed invention provides a unique solution to the engineering constraints and challenges of providing a traffic barrier and soundwall system that provides increased safety and cost-efficient installation and repair. Further, the embodiments of the disclosed invention satisfy the crash test requirements of AASHTO MASH TL-4.

The advantages and features of the embodiments presently disclosed will become more readily understood from the following detailed description and appended claims when read in conjunction with the accompanying drawings in which like numerals represent like elements.

SUMMARY

A traffic barrier and soundwall system is disclosed. In one embodiment, a plurality of wide-flanged vertical posts is provided. The posts have a central web with a first flange centered on one end of the web and a second flange centered on the opposite end of the web. The posts are oriented with the first flange facing a roadway along which traffic sound is to be limited.

A first traffic barrier is located between a first and second post. A second traffic barrier is located between the second and a third post. Each traffic barrier comprises a front and an opposite back, a first end and an opposite second end, and a top and a bottom. A first recess is located at the intersection of the back and the first end. A second recess is located at the intersection of the back and the second end. The first recess and second recess each have a recess front and a recess end.

In one embodiment, one or more threaded inserts are precast into the traffic barrier, facing the recess end of each of the first and second recess. The inserts may be connected to a reinforcing rebar structure that is also precast internal to the traffic barrier. The inserts may include a bracket insert and a strap insert.

An angle bracket is provided. The angle bracket has a bracket front and a bracket end. An orifice may be located on the angle bracket end for receiving a bracket fastener. The angle bracket is located at the intersection of the recess front and recess end of each of the first and second recesses of the first and second traffic barriers.

A bracket fastener located in the orifice of each angle bracket connects to a bracket insert at each recess end of each traffic barrier to secure the angle bracket to the traffic barrier. The bracket inserts may be connected to the reinforcing rebar structure that is also precast internal to the traffic barrier.

The first and second traffic barriers are positioned about the posts so that the bracket fronts in the recesses of the traffic barriers are adjacent to the first flange of a post to prevent engagement of the concrete bodies of the traffic barriers with the first flange of the post.

To minimize damage resulting from engagement of the concrete traffic barrier with the steel post, the angle bracket may be made of metal, such as steel. In another embodiment, the angle bracket is made of a compressible material such as a thermoplastic polymer. In another embodiment, the angle bracket is made of a high-density polyethylene (HDPE).

A plurality of U-shaped strap connectors is provided, each having a base and a pair of arms extending perpendicularly from the base, and an orifice is located on each arm for receiving a strap fastener.

A strap fastener connects one arm of the strap connector to a strap insert in the first recess of the first traffic barrier. Another strap fastener connects the other arm of the strap connector to a strap insert in the second recess of the second traffic barrier. The strap inserts may be connected to the reinforcing rebar structure that is also precast internal to the traffic barrier.

In another embodiment, the strap fastener is located proximate to the top of the first traffic barrier to permit tool entry access for rotating the strap fastener to make its connection to the first traffic barrier.

Connected in the manner described, and as unique to the present invention, the base of the strap connector surrounds the second flange of the second post to interconnect longitudinal steel reinforcement within the first and second traffic barriers around the vertical post to provide a continuous tensile member along the back side of the system.

A sound barrier panel is located on the top of the traffic barriers and extends between the web of the first post and the web of the second post. In one embodiment, the sound panels have a longitudinal slot along the length of their bottom edge. The sound panels also have a longitudinal ridge along the length of their top edge. In this manner, sound barrier panels may be stacked between the web of the first post and the web of the second post to the desired height. The slots and ridges of vertically adjacent sound panels nest to enhance alignment and sound absorption.

A first crash panel is located above one or more sound panels positioned above the first traffic barrier and extends between the first and second post. A second crash panel is located above one or more sound panels positioned above the second traffic barrier and extends between the second post and the third post.

The crash panels have a front and an opposite back, a first end and an opposite second end, and a top and a bottom. Each crash panel has a first end and an opposite second end. A first recess is located at the intersection of the back and the first end of each crash panel. A second recess is located at the intersection of the back and the second end of each crash panel. The first recess and second recess have a recess front and a recess end.

In one embodiment, one or more threaded inserts are precast into the crash panels, facing the recess end of each of the first and second recess. The inserts may be connected to a reinforcing rebar structure that is also precast internal to the crash panels. The inserts may include a bracket insert and a strap insert.

An angle bracket is provided. The angle bracket has a bracket front and a bracket end. An orifice may be located on the angle bracket end for receiving a bracket fastener. The angle bracket is located at the intersection of the recess front and recess end of each of the first and second recesses of the first and second crash panels.

A bracket fastener located in the orifice of each angle bracket connects to a bracket insert at each recess end of each crash panel to secure the angle bracket to the crash panel. The bracket inserts may be connected to the reinforcing rebar structure that is also precast internal to the traffic barrier.

A plurality of U-shaped strap connectors is provided, each having a base and a pair of arms extending perpendicularly from the base, and an orifice is located on each arm for receiving a strap fastener.

The first and second crash panels are positioned about the posts so that the bracket fronts in the recesses of the crash panels are adjacent to the first flange of the post to prevent engagement of the concrete bodies of the crash panels with the first flange of the post.

To minimize damage resulting from engagement of the concrete crash panel with the steel post, the angle bracket may be made of metal, such as steel. In another embodiment, the angle bracket is made of a compressible material such as a thermoplastic polymer. In another embodiment, the angle bracket is made of a high-density polyethylene (HDPE).

A strap fastener connects one arm of the strap connector to a strap insert in the first recess of the first crash panel. Another strap fastener connects the other arm of the strap connector to a strap insert in the second recess of the second crash panel. The strap inserts may be connected to the reinforcing rebar structure that is also precast internal to the crash panel.

Connected in the manner described, and as unique to the present invention, the base of the strap connector surrounds the second flange of the second post to interconnect longitudinal steel reinforcement within the first and second crash panels around the vertical post to provide a continuous tensile member along the back side of the system.

In another embodiment, a third sound panel is located on top of the first crash panel, between the first post and the second post. In another embodiment, a panel spacer may be located between the sound panel front and the first flange of the first post, and between the sound panel front and the first flange of the second post.

In another embodiment, a seam cover is provided. The seam cover may be U-shaped with a cover front and a pair of opposing cover sides extending from the cover front.

In this embodiment, each crash panel may have a shallow surface relief on each of its first and second ends. The surface relief extends from the top of the crash panel to the front of the crash panel and to the bottom of the crash panel.

The seam cover is placed over the surface relief on the first end of the first crash panel and the surface relief on the second end of the second crash panel, such that it extends between the first and second crash panels to cover the gap between them. In this embodiment, the front of the seam cover provides an even surface with the front of the crash panels.

Orifices are located along the cover sides for receiving cover fasteners. The cover fasteners positioned through the orifices may connect the seam cover to a cover insert embedded in the concrete of the crash panel to attach the seam cover to the respective ends of adjacent crash panels.

The seam cover allows the tops of truck containers that engage the crash panels to slide across the intersections of the crash panels without impacting the ends of the crash panels in a manner that disrupts the movement of the engaging truck container.

In another embodiment, a pair of lifting anchors is provided on the top surface of the crash panels for raising the crash panels into position. The lifting anchors are inserts embedded in the concrete of the crash panels.

In another embodiment, the crash panels have an elongated slot extending along the bottom, and an elongated ridge extending along the top. The sound panels also have an elongated slot extending along the bottom, and an elongated ridge extending along the top. The slots and ridges of vertically adjacent sound and crash panels are nested together to eliminate gaps between them.

In another embodiment, the first traffic barrier has an internal network of reinforcing steel. In another embodiment, the first crash panel has an internal network of reinforcing steel.

In another embodiment, the first traffic barrier and first crash panel are precast concrete having a minimum compressive strength of 28 MPa (4000 psi).

In another embodiment, the front sides of the traffic barriers have a sloped portion for controlled redirection of impacting trucks or other vehicles.

In another embodiment, the strap fastener is located very near the top of the traffic barrier to permit access for rotating the strap fastener to make its connection to the traffic barrier.

In another embodiment, the vertical post may be an I-Beam or an H-Beam or W-flange Beam, all deemed to have an H-Shape for the purposes of this disclosure. In another embodiment, a subterranean footer surrounds the post below ground level. In another embodiment, the vertical post comprises a metric W250×49 steel post [US Customary W10×33]. In another embodiment, where exposed to higher wind loads or elevations, the vertical post comprises a metric W250×58 or W250×67 steel post.

A traffic barrier and soundwall system is disclosed which includes a crash panel. In one embodiment, a plurality of wide-flanged vertical posts is provided. The posts have a central web with a first flange centered on one end of the web and a second flange centered on the opposite end of the web. The posts are oriented with the first flange facing a roadway along which traffic sound is to be limited.

DETAILED DESCRIPTION

The following description is presented to enable any person skilled in the art to make and use the invention and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown but is to be accorded the widest scope consistent with the principles and features disclosed herein.

Figure 1:
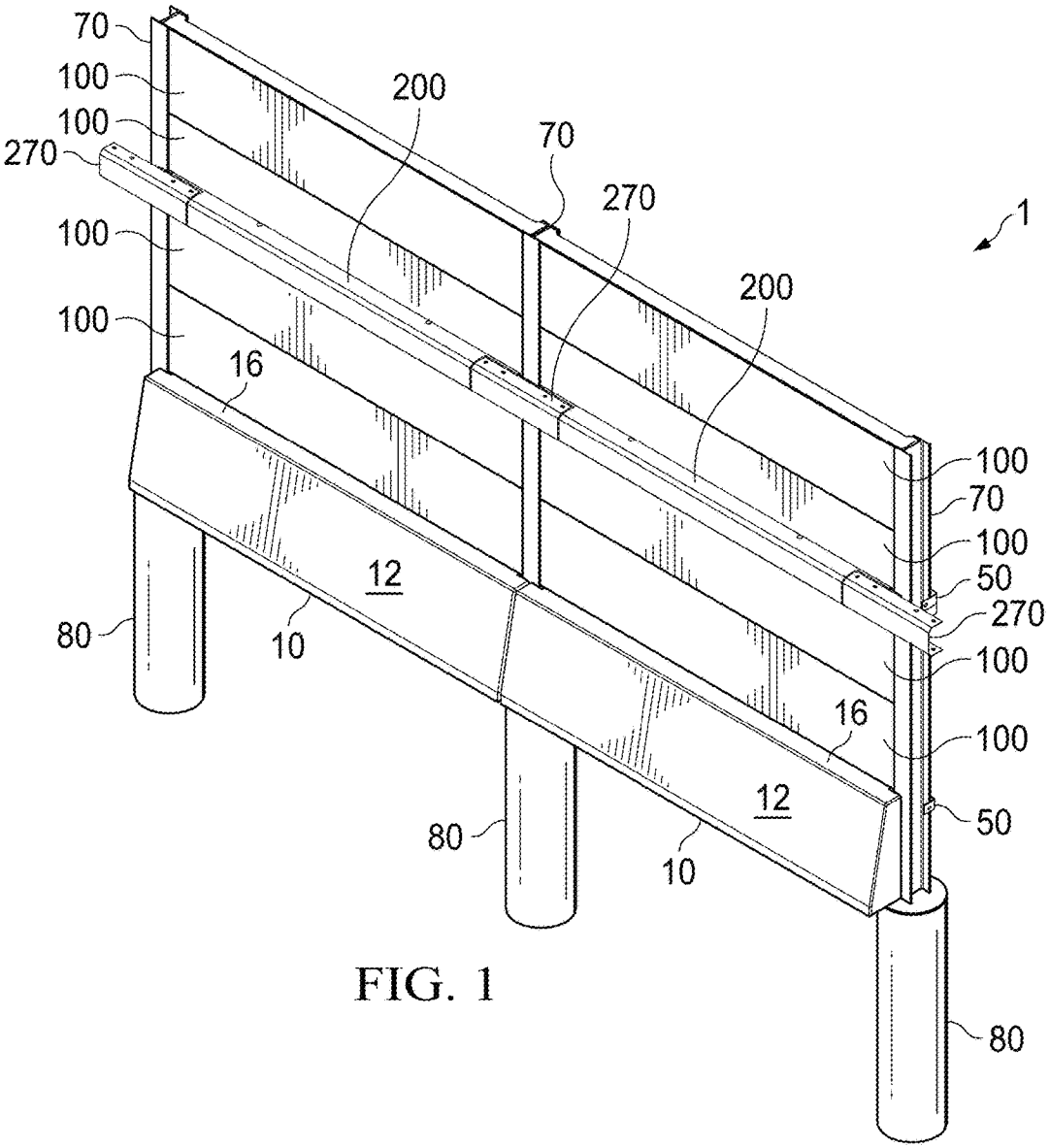
FIG. 1 is a perspective view of the front of a traffic barrier and soundwall system in accordance with one embodiment of the invention.

FIG. 1 is a perspective view of the front of a traffic barrier and soundwall system 1 in accordance with one embodiment of the invention. As shown in FIG. 1, subterranean footers 80 may be made of concrete and include reinforcing steel members 90 (not shown). A post 70 extends vertically upwards from footers 80. Traffic barriers 10 may be made of numerous materials, including most commonly of precast concrete. Traffic barriers 10 have a front 12 and a top 16.

In accordance with this embodiment, traffic barriers 10 can be beneficially positioned without the time, cost, or risk of raising them above posts 70. As a further benefit of this embodiment, traffic barriers 10 need not be welded or bolted directly to posts 70.

Sound barrier panels 100 are set between posts 70, and on top 16 of concrete traffic barriers 10. Additional sound barrier panels 100 may also be set between posts 70, on the top of the lower positioned sound barrier panels 100. Crash panels 200 are set between posts 70, and on top of sound barrier panels 100. Seam covers 270 span between adjacent crash panels 200 to cover the open seam between them at post 70. Additional sound barrier panels 100 may be set between posts 70 on top of crash panels 200.

Figure 2:
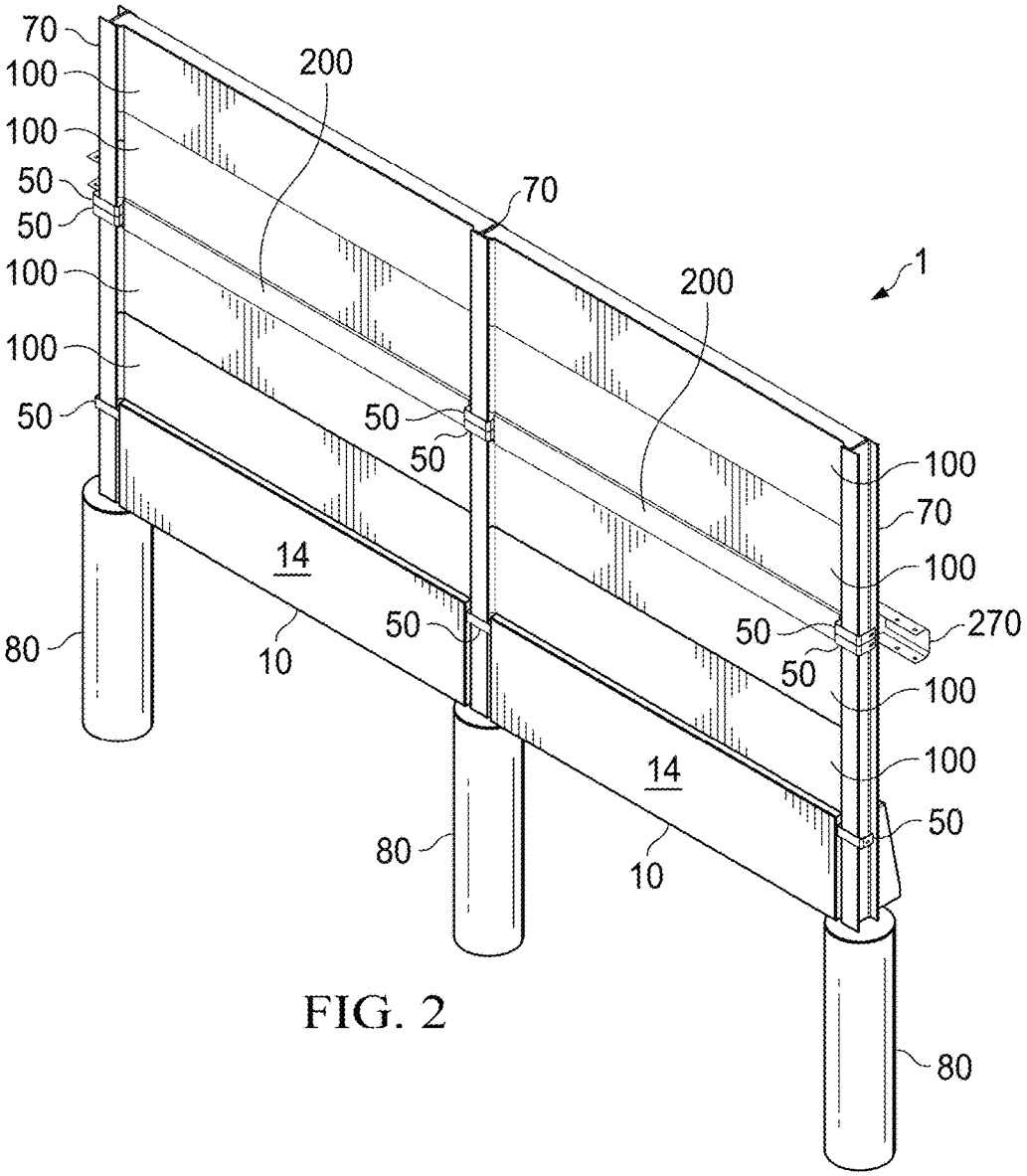
FIG. 2 is a perspective view of the back side of the traffic barrier and soundwall system illustrated in FIG. 1.

FIG. 2 is a rear perspective view of this embodiment. As shown in FIG. 2, traffic barriers 10 are positioned between posts 70 in approximate alignment with back 14 of traffic barriers 10. Traffic barriers 10 are connected to each other around posts 70 by means of a connection strap 50. The connection of adjacent sections of traffic barriers 10 to each other around posts 70 and to footers 80 provides a significantly improved resistance to dislocation of traffic barriers 10, significantly improves resistance to damage to sound barrier panels 100 and reduces risk to vehicle occupants upon impact of vehicles with traffic barrier and soundwall system 1.

As also seen in this view, crash panels 200 are also connected to each other around posts 70 by means of a connection strap 50. As will be seen in FIGS. 13 and 22, strap connections 50 are connected to the steel reinforcement structures 90 within the traffic barriers 10 and crash panels 200. Interconnecting the longitudinal steel reinforcement 90 within first and second traffic barriers 10 around vertical post 70 and interconnecting the longitudinal steel reinforcement 90 within first and second crash panels 200 around vertical post 70 provides a continuous tensile member along the back side of traffic barrier and soundwall system 1 that is unique in structure and performance, and ease of assembly and repair.

Figure 3:
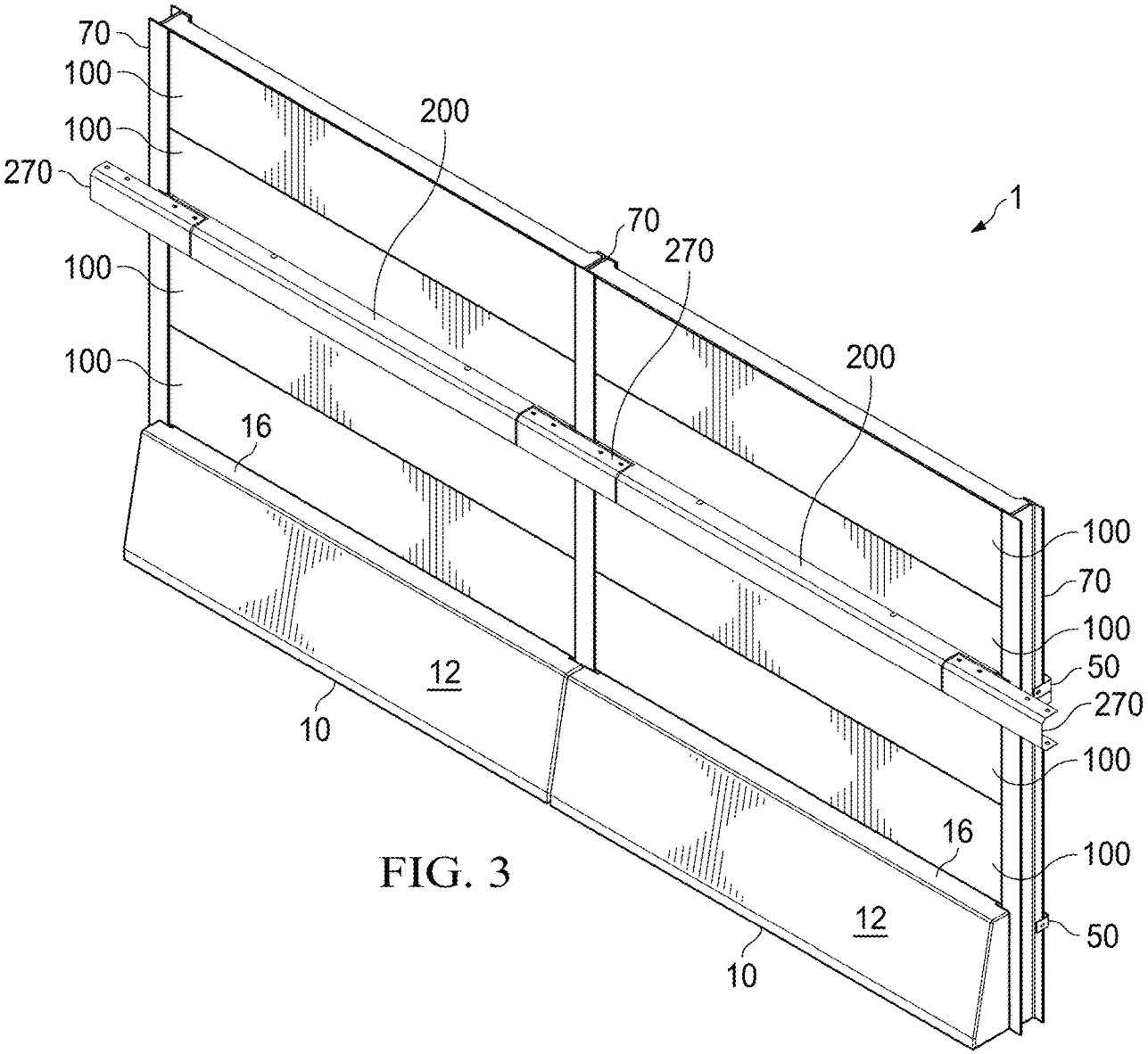
FIG. 3 is a perspective view of the front of a traffic barrier and soundwall system in accordance with another embodiment of the invention, in which no subterranean footers are used.

FIG. 3 is a perspective view of the front of a traffic barrier and soundwall system 1 in accordance with another embodiment of the invention in which no subterranean footers 80 are used.

Figure 4:
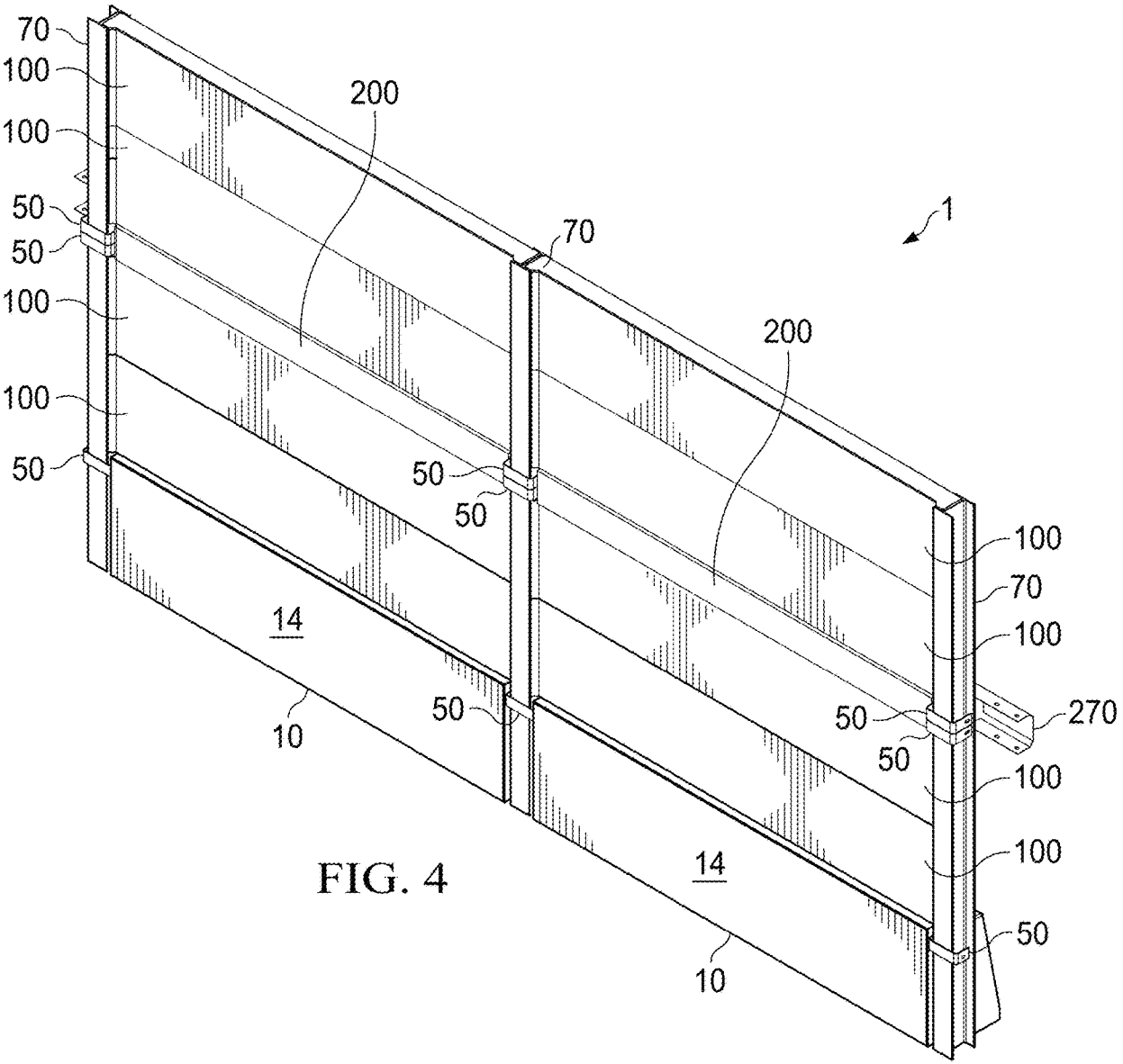
FIG. 4 is a perspective view of the back side of the traffic barrier and soundwall system illustrated in FIG. 3.
Figure 13:
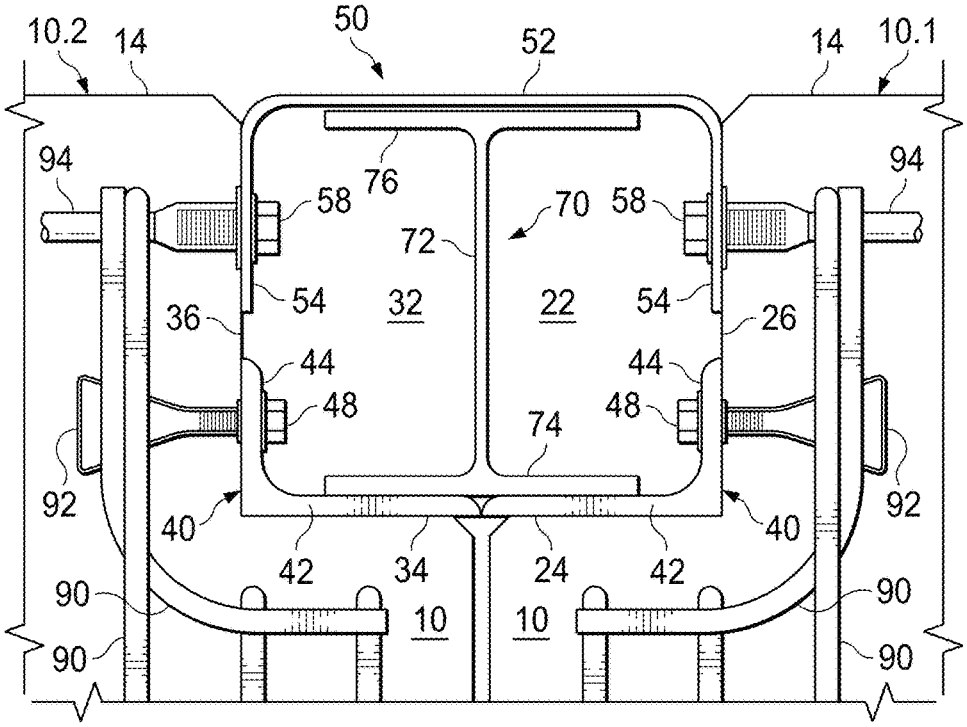
FIG. 13 is a top view of the brackets and connector embodiments of FIGS. 10-12, illustrated connecting adjacent traffic barriers to each other in accordance with an embodiment of the invention.

FIG. 4 is a perspective view from the back side of traffic barrier and soundwall system 1. As seen in this view, strap connectors 50 extend around post 70 for connection between sequential traffic barriers 10 and between sequential crash panels 200. As best seen in FIG. 13, contact between traffic barriers 10 and posts 70 is buffered by the presence of angle brackets 40.

Figure 5:
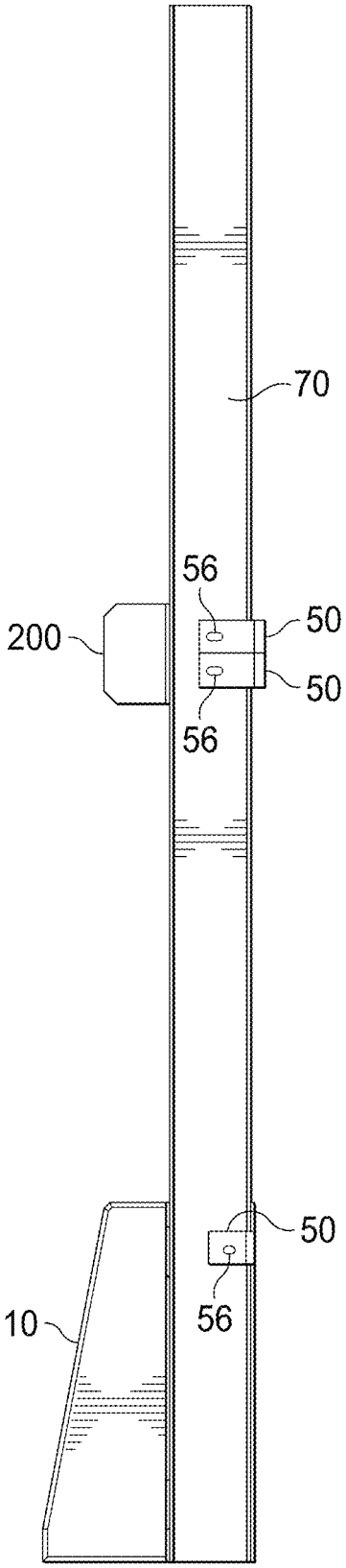
FIG. 5 is a side view of the traffic barrier and soundwall system illustrated in FIG. 1.

FIG. 5 is a side view of traffic barrier and soundwall system 1. As seen in this view, strap connectors 50 extend beyond post 70 for connection to the next traffic barrier 10 and crash panel 200.

Figure 6:
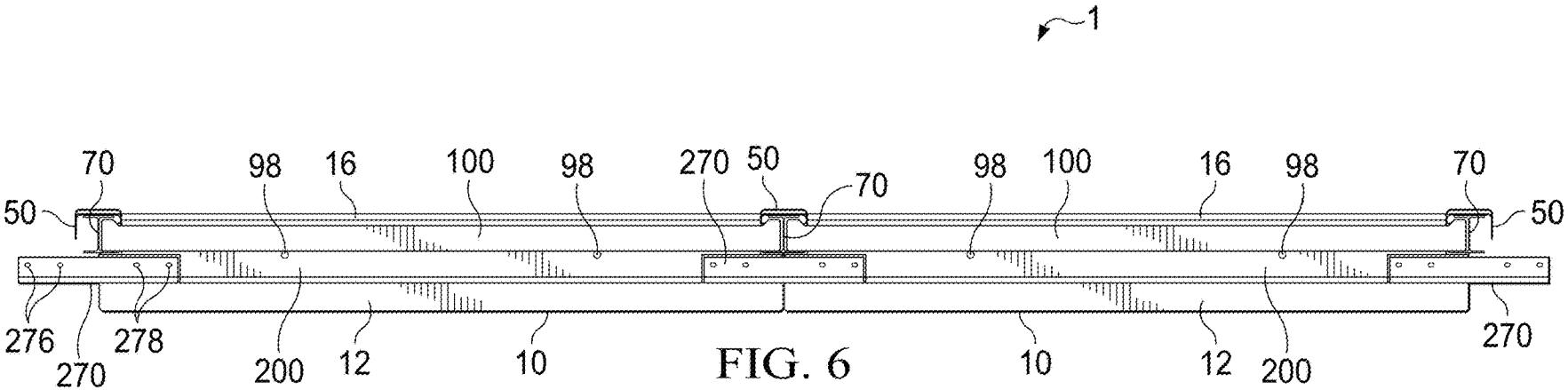
FIG. 6 is a top view of the traffic barrier and soundwall system illustrated in FIG. 1.

FIG. 6 is a top view of traffic barrier and soundwall system 1. For the purposes of this view, traffic barrier and soundwall system 1 is illustrated from above crash panels 200, with no sound panels 100 positioned above crash panels 200. As seen in FIG. 6, a seam cover 270 is provided at the junction between adjacent crash panels 200. A plurality of orifices 276 is located on each seam cover 270 for receiving a cover fastener 278 (best seen in FIG. 24) for securing seam cover 270 to the ends of adjacent crash panels 200.

Seam cover 270 allows the tops of truck containers that engage a crash panel 200 to slide across its intersection with the next adjacent crash panel 200 without impacting crash panel ends 220 or 230 (see FIG. 18) in a manner that disrupts the movement of the engaging truck container. The result is a reduction in damage to traffic barrier and soundwall system 1, and elimination of snagging engagement of the truck container in a manner that generates impact forces and undesirable rotation of the truck back into traffic.

Figure 7:
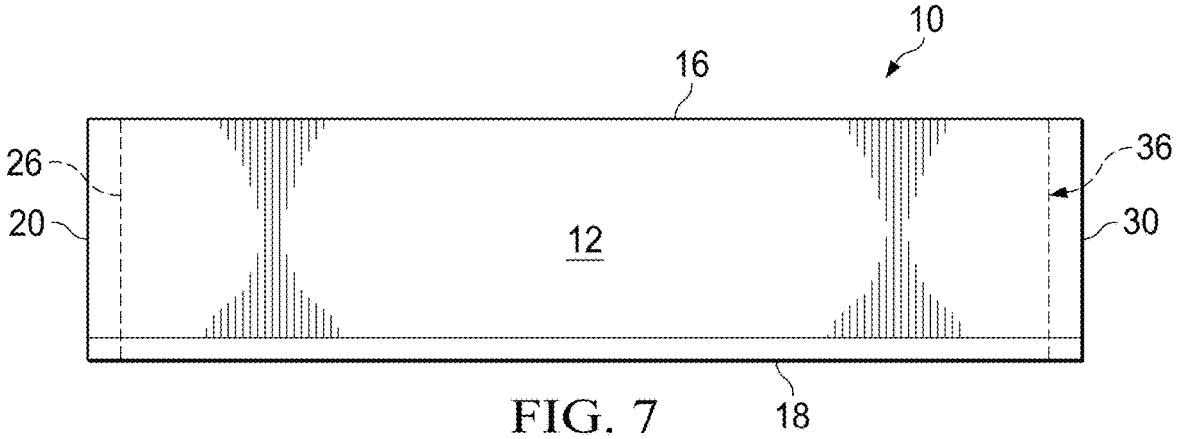
FIG. 7 is a front view of an embodiment of a traffic barrier 10 as may be incorporated into the traffic barrier and soundwall system 1 illustrated in FIG. 1.
Figure 8:
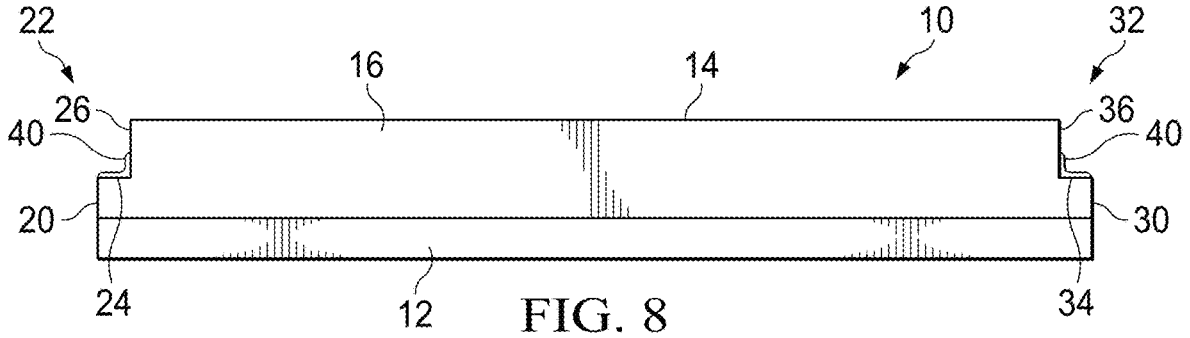
FIG. 8 is a top view of the embodiment of the traffic barrier illustrated in FIG. 7.
Figure 9:
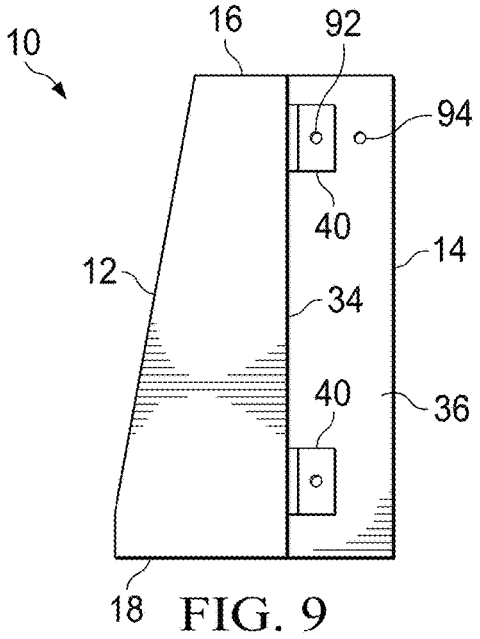
FIG. 9 is a side view of the embodiment of the traffic barrier illustrated in FIG. 7.

FIG. 7 is a front view of an embodiment of traffic barrier 10 as may be incorporated into traffic barrier and soundwall system 1. FIG. 8 is a top view of the same embodiment of traffic barrier 10, and FIG. 9 is a side view of the same embodiment. Referring to FIGS. 7-9, traffic barrier 10 comprises a front 12 and an opposite back 14, and a top 16 and a bottom 18. In one embodiment, front surface 12 is angled towards back 14 at an angle of approximately 10 degrees, making top 16 narrower than bottom 18.

Traffic barrier 10 also has a first end 20 and an opposite second end 30. A first recess 22 is located at the intersection of back 14 and first end 20. A second recess 32 is located at the intersection of back 14 and second end 30. First recess 22 has a recess front 24 and a recess end 26. Similarly, second recess 32 has a recess front 34 and a recess end 36. Recess 22 and recess 32 are sized to accommodate one-half of the width of post 70.

Figure 10:
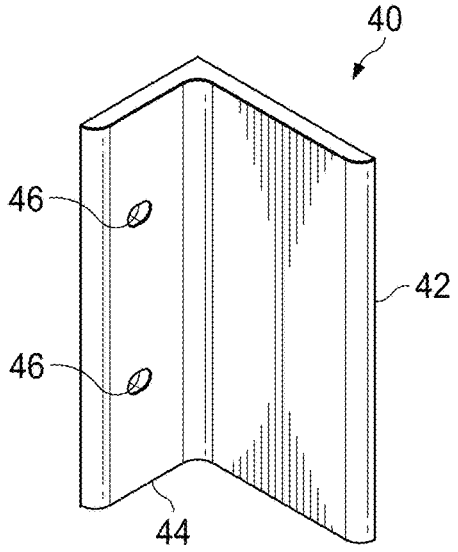
FIG. 10 is an isometric view of an embodiment of an angle bracket as may be incorporated into the traffic barrier and soundwall system illustrated in FIG. 1.

FIG. 10 is a top view of an embodiment of angle bracket 40 as may be incorporated into traffic barrier and soundwall system 1 illustrated in FIG. 1. Angle bracket 40 has a bracket front 42 and a bracket end 44. One or more orifices 46 are located on bracket end 44 of angle bracket 40 for receiving a bracket fastener 48 (see FIG. 13).

Figure 11:
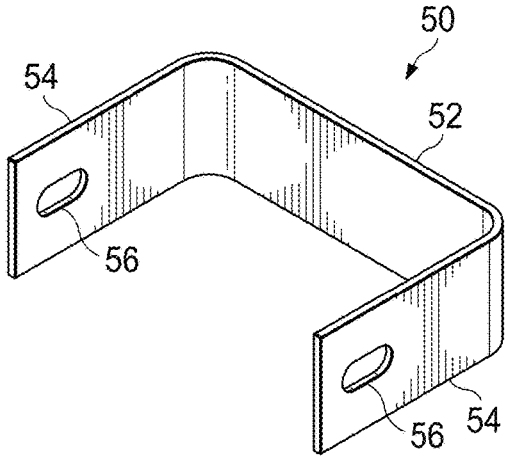
FIG. 11 is an isometric view of an embodiment of a connector strap as may be incorporated into the traffic barrier and soundwall system illustrated in FIG. 1.

FIG. 11 is an isometric view of an embodiment of U-shaped strap connector 50 as may be incorporated into the traffic barrier and soundwall system illustrated in FIG. 1. Strap connector 50 has a base 52 and a pair of arms 54 extending perpendicularly away from base 52. An orifice 56 is located on each arm 54 for receiving a strap fastener 58 (see FIG. 13).

Figure 12:
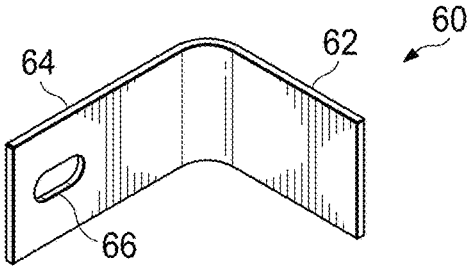
FIG. 12 is an isometric view of an embodiment of a half-strap connector as may be incorporated into the traffic barrier and soundwall system illustrated in FIG. 1.

FIG. 12 is an isometric view of an embodiment of a half-strap connector 60 as may be incorporated into the traffic barrier and soundwall system illustrated in FIG. 1. Half-strap 60 is advantageous for use at each end of a run of series connected crash panels 200. Half-strap 60 provides support for orientation of the first and last crash panels 200 in a series by securing them against post 70. Half-strap 60 has a base 62 and an arm 64 extending perpendicularly away from base 62. An orifice 66 is located on arm 64 for receiving a strap fastener 58.

FIG. 13 is a top view of angle brackets 40 and strap connector 50 illustrating the connection of adjacent traffic barriers 10.1 and 10.2 around post 70 in the manner that is unique to the present invention. As best seen in this view (see also FIGS. 1-4), post 70 is located along a roadway to be barricaded.

Post 70 is a wide-flanged vertical post. As used herein, the term "wide-flanged post" is understood to include I-Beams, H-Beams or W-flange Beams, all of which are beams understood to generally have an H-Shape. As used herein, the term "post" is understood to include vertically positioned beams.

In the embodiment illustrated, post 70 is "H-shaped". In one embodiment, post 70 is a metric W250×49 [US Customary W10×33] steel post. Post 70 has a central web 72 and a first flange 74 centered on an end of web 72. A second flange 76 is centered on an opposite end of web 72. First flange 74 and second flange 76 are identified separately only for the purpose of describing the orientation of post 70, as first flange 74 and second flange 76 are structurally identical.

Post 70 is oriented with first flange 74 facing a roadway to be barricaded. First traffic barrier 10.1 is positioned with first recess 22 on the right side of post 70. Second traffic barrier 10.2 is positioned adjacent to first traffic barrier 10.1 with second recess 32 of second traffic barrier 10.2 on the left side of post 70. In this position, angle brackets 40 of first and second traffic barriers 10.1 and 10.2 engaged first flange 74 of post 70.

Connection strap 50 is then positioned against second flange 76 of post 70. Strap fastener 58 secures one arm 54 of connection strap 50 to recess end 26 of first traffic barrier 10.1. Another strap fastener 58 secures the other arm 54 of connection strap 50 to recess end 36 of second traffic barrier 10.2. Base 52 of connection strap 50 surrounds second flange 76 of post 70 and thus secures first traffic barrier 10.1 and second traffic barrier 10.2 together around post 70.

In the embodiment illustrated, strap fastener 58 is threadedly connected to a strap insert 94. Strap insert 94 is precast into the concrete body of traffic barrier 10 and connected to the network of reinforcing steel members 90 within traffic barrier 10. The connections thus realized provide a superior resistance to dislocation of traffic barriers 10 and significantly enhanced protection of sound barrier elements 100. More specifically, dislocation of any traffic barrier 10 results in a tensile distribution of the stress of the impact throughout the length of series connected traffic barriers 10.

As shown in FIG. 13, angle bracket 40 is located in each of first recess 22 of traffic barrier 10.1 and second recess 32 of adjacent traffic barrier 10.2. Angle bracket 40 is located at the intersection of recess front 24 and recess end 26 of first recess 22. Angle bracket 40 is located such that bracket front 42 is positioned against recess front 24 and bracket end 44 is positioned against recess end 26. Bracket fastener 48 secures angle bracket 40 to traffic barrier 10.1. In the embodiment illustrated, bracket fastener 48 is threadedly connected to a bracket insert 92. Bracket insert 92 is precast into the concrete body of traffic barrier 10 and connected to the network of reinforcing steel members 90 within traffic barrier 10.

An angle bracket 40 is similarly located at the intersection of recess front 34 and recess end 36 of second recess 32 of adjacent traffic barrier 10.2 and connected in the same manner as angle bracket 40 is in first recess 22 of traffic barrier 10.1.

Angle brackets 40 function to provide an intermediate engagement with steel post 70. When trucks or other vehicles impact traffic barrier and soundwall system 1 and produce lateral loads into traffic barrier 10, engagement between angle brackets 40 and post 70 minimizes damage to the concrete surfaces of traffic barrier 10.

To minimize damage resulting from engagement of concrete traffic barrier 10 with steel post 70, angle bracket 40 may be made of metal, such as steel. In another embodiment, angle bracket 40 is made of a compressible material such as a thermoplastic polymer. In another embodiment, angle bracket 40 is made of a high-density polyethylene (HDPE).

Figure 15:
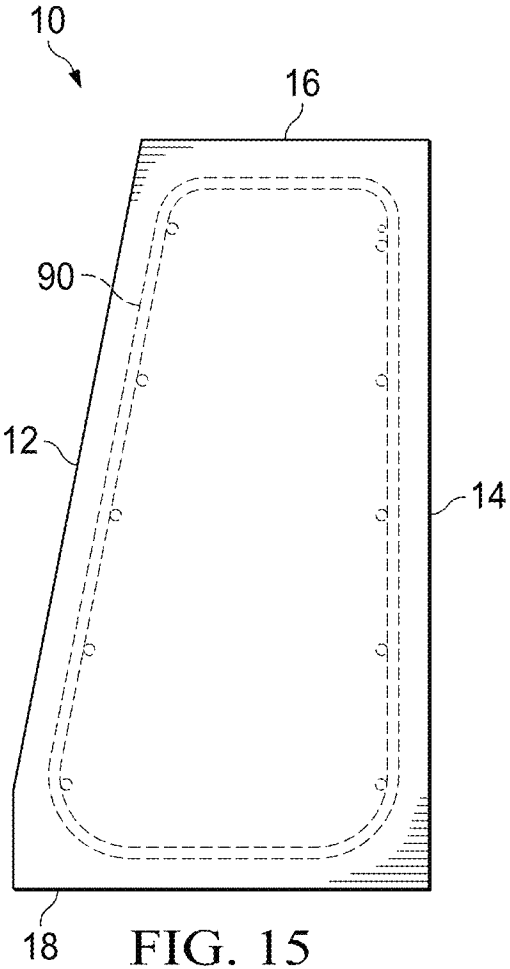
FIG. 15 is a center portion side-sectional view illustrating an exemplary reinforcing steel structure.
Figure 14:
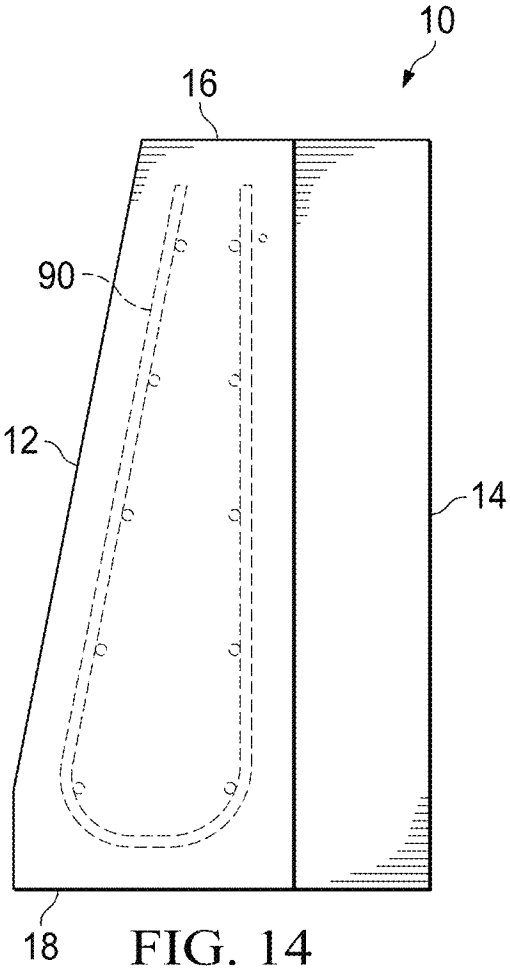
FIG. 14 is an end portion side-sectional view illustrating an exemplary reinforcing steel structure.
Figure 16:
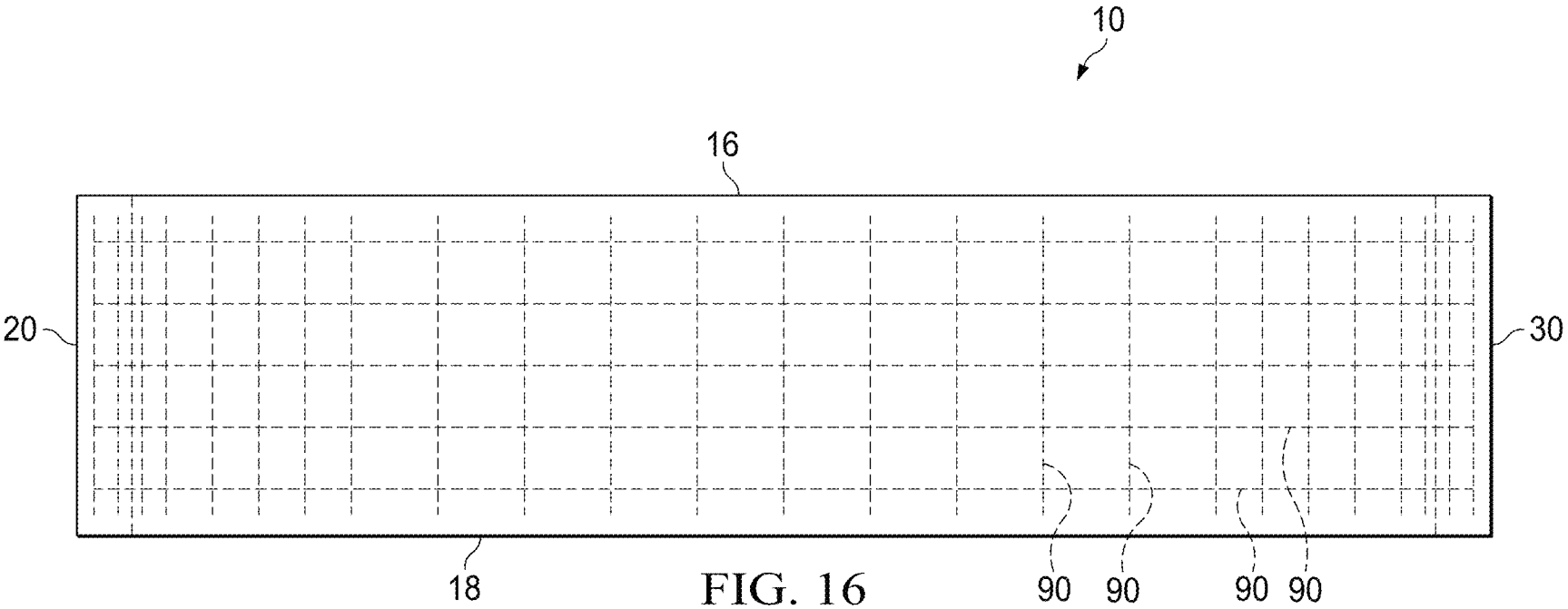
FIG. 16 is a front-sectional view illustrating an exemplary reinforcing steel structure.

FIG. 14 is an end portion side-sectional view of traffic barrier 10 illustrating an exemplary reinforcing steel structure member 90 interior to traffic barrier 10. FIG. 15 is a center portion side-sectional view illustrating an exemplary network of reinforcing steel structure members 90. FIG. 16 is a front-sectional view illustrating an exemplary reinforcing steel structure 90.

Figure 17:
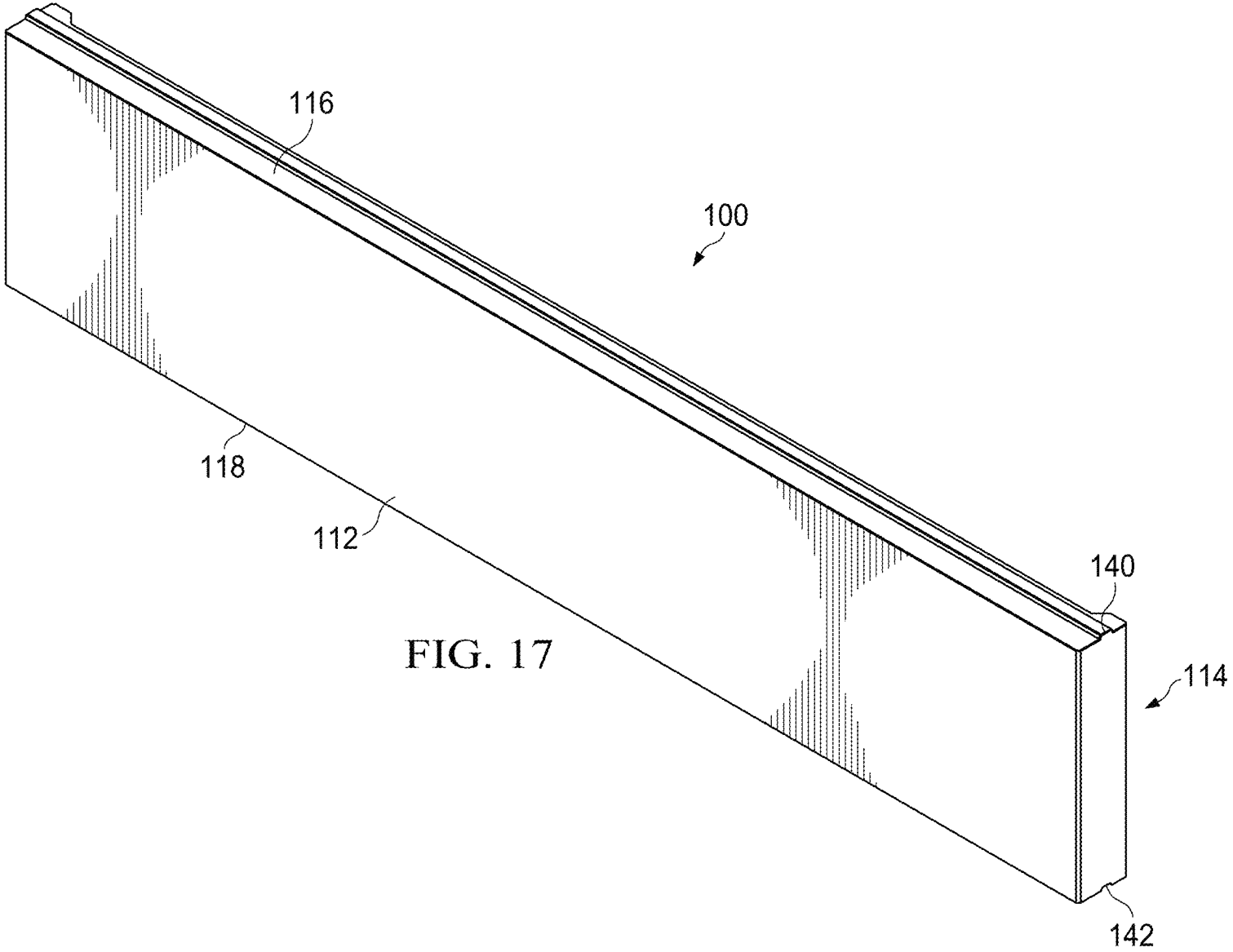
FIG. 17 is an isometric view of a sound panel as may be incorporated into the traffic barrier and soundwall system illustrated in FIG. 1.

FIG. 17 is an isometric view of sound panel 100 as may be incorporated into the traffic barrier and soundwall system 1 as illustrated in FIGS. 1-4. Sound panel 100 has a front 112 and an opposite back 114, a top 116, and a bottom 118. Ridge 140 extends the length of sound panel top 116. A complementary slot 142 extends the length of sound panel bottom 118. When sound panels 100 are located in vertical alignment between consecutive posts 70, sound panel slot 142 of the upper sound panel 100 receives sound panel ridge 140 of the lower sound panel 100. This engagement between vertically adjacent sound panels 100 provides enhanced assembly and sound dampening or reflecting properties.

Figure 18:
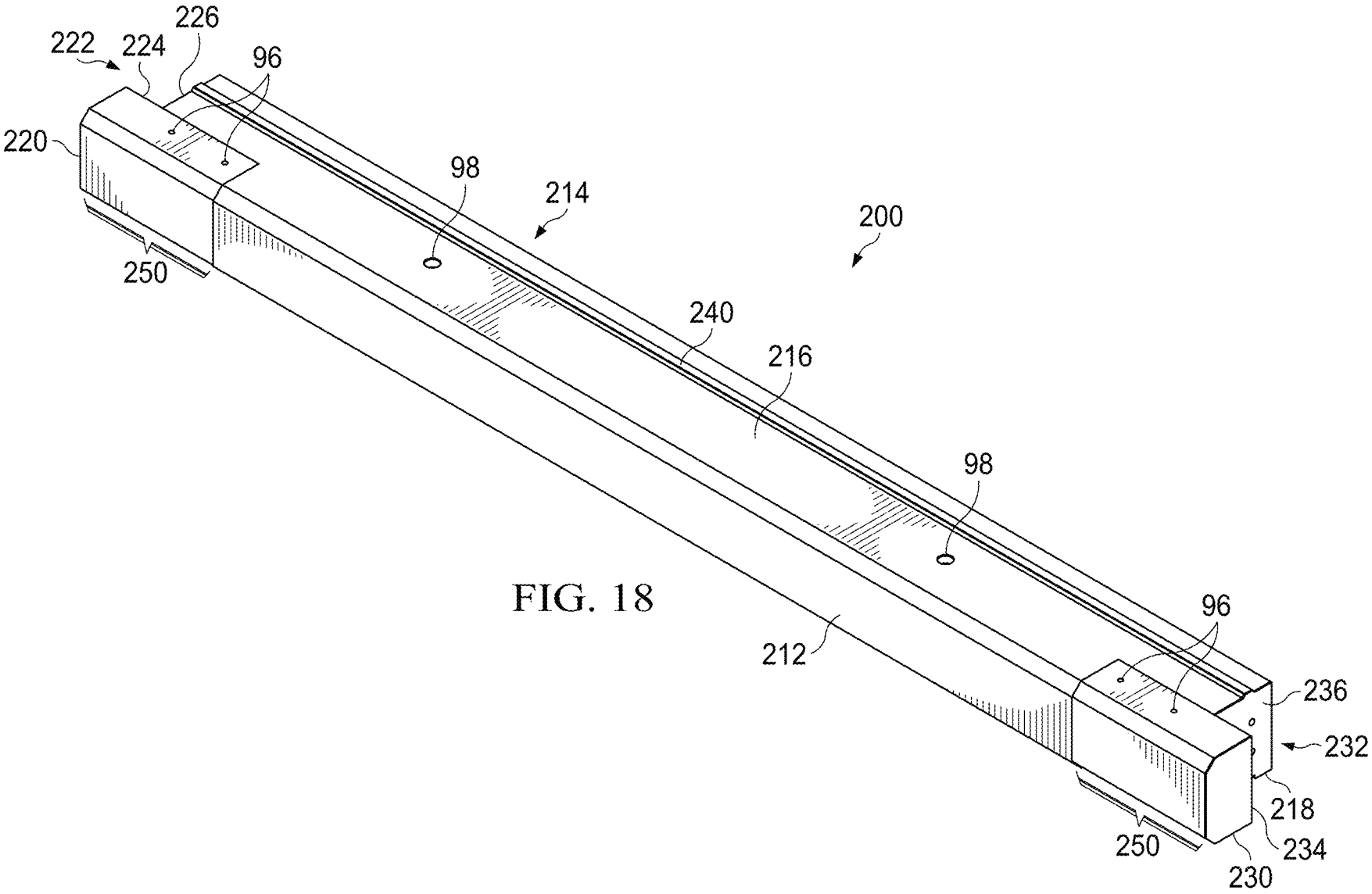
FIG. 18 is a top isometric view of an crash panel as may be incorporated into the traffic barrier and soundwall system illustrated in FIG. 1.

FIG. 18 is a top isometric view of crash panel 200 as may be incorporated into the traffic barrier and soundwall system 1 illustrated in FIG. 1. As illustrated, crash panel 200 has a front 212, an opposite back 214, a top 216, and a bottom 218. Crash panel 200 also has a first end 220 and an opposite second end 230. A first recess 222 is located at the intersection of back 214 and first end 220. A second recess 232 is located at the intersection of back 214 and second end 230. First recess 222 has a recess front 224 and a recess end 226. Similarly, second recess 232 has a recess front 234 and a recess end 236. Recess 222 and recess 232 are sized to accommodate one-half of the width of post 70.

A surface relief 250 is located at first end 220 and second end 230. Cover inserts 96 are located on surface relief 250 for receiving cover fasteners 278 for attaching seam covers 270 to crash panel 200. Lifting inserts 98 intersect with top 216 of crash panel 200 to provide a threaded connection for a lifting eye to lift crash panel 200 into place.

Figure 20:
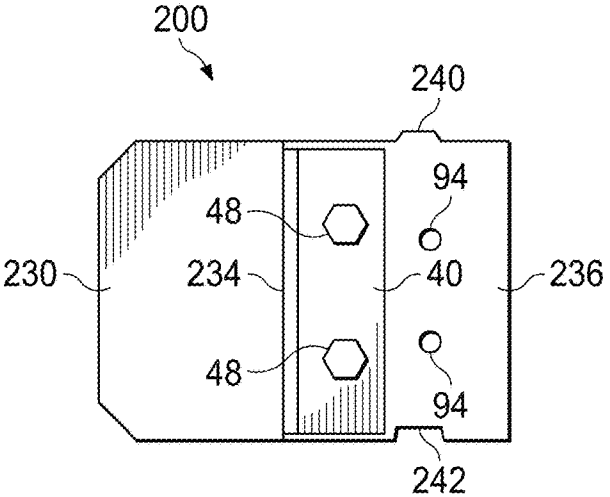
FIG. 20 is an end of the embodiment of the crash panel of FIG. 18.

Crash panel 200 has an elongated ridge 240 extending along top 216, and an elongated slot 242 extending along bottom 218 (shown in FIG. 20). When crash panel 200 is located in vertical alignment above a sound panel 100 between consecutive posts 70, slot 242 of crash panel 200 receives ridge 140 of sound panel 100 beneath crash panel 200. Similarly, when a sound panel 100 is placed in vertical alignment above crash panel 200, slot 142 of the upper sound panel 100 above receives ridge 240 of crash panel 200 beneath sound panel 100. This engagement between vertically adjacent sound panels 100 and crash panels 200 provides enhanced assembly and sound dampening and reflecting properties.

Figure 19:
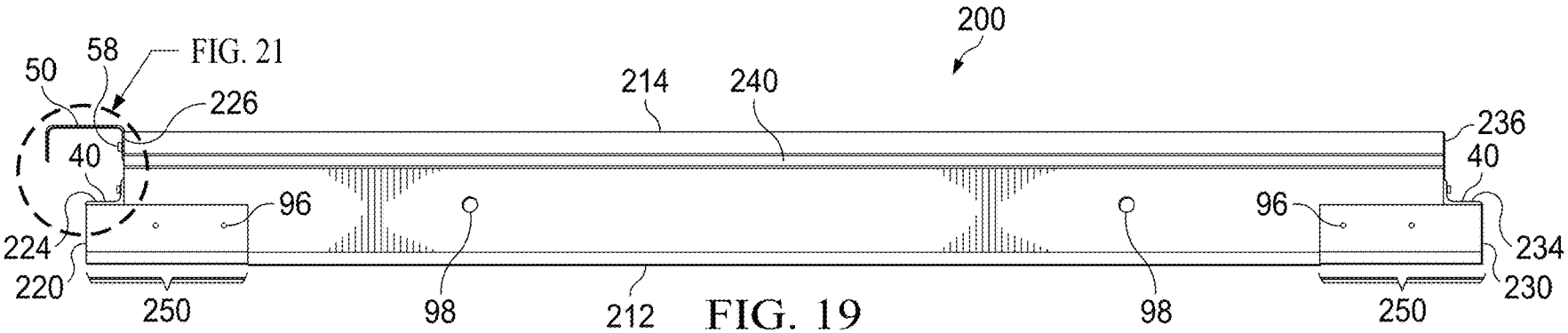
FIG. 19 is a front view of the embodiment of the crash panel of FIG. 18.

FIG. 19 is a top view of the embodiment of crash panel 200 of FIG. 18. In this view, angle brackets 40 have been attached to each of first end 220 and second end 230. A strap connector 50 has been attached to first end 220 of crash panel 200.

FIG. 20 is an end view of the embodiment of the crash panel 200 of FIG. 19. FIG. 19 illustrates second end 230 showing recess front 234 intersecting with recess end 236. Angle bracket 40 is located at the intersection of recess front 234 and recess end 236. Angle bracket 40 is secured in place with bracket fasteners 48. As seen in this view, strap inserts 94 intersect recess end 236 to receive strap fasteners 58 in threaded connection. As also seen in this view, crash panel slot 242 extends the length of crash panel 200.

Figure 21:
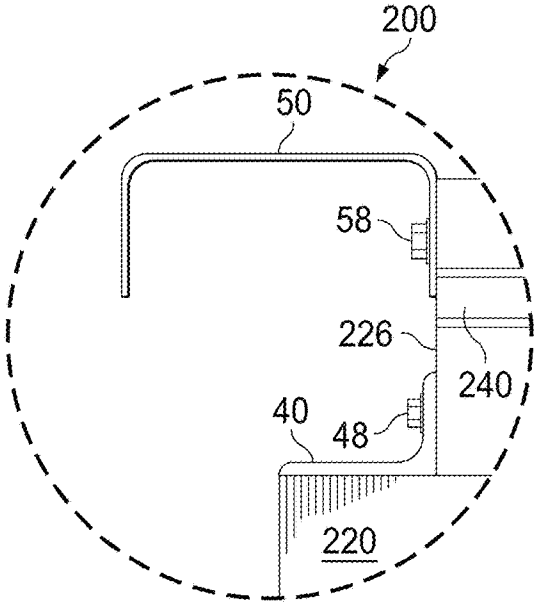
FIG. 21 is a close-up top view of the first end of the embodiment of the crash panel of FIG. 19 illustrating the attachment of an angle bracket and strap connector as may be incorporated into the traffic barrier and soundwall system illustrated in FIG. 1.

FIG. 21 is a close-up top view of first end 220 of crash panel 200 of FIG. 19 illustrating the attachment of angle bracket 40 and strap connector 50. Strap fastener 58 secures strap connector 50 to recess end 226 of crash panel 200. Bracket fastener 48 secures angle bracket 40 to recess end 226 of crash panel 200.

Figure 22:
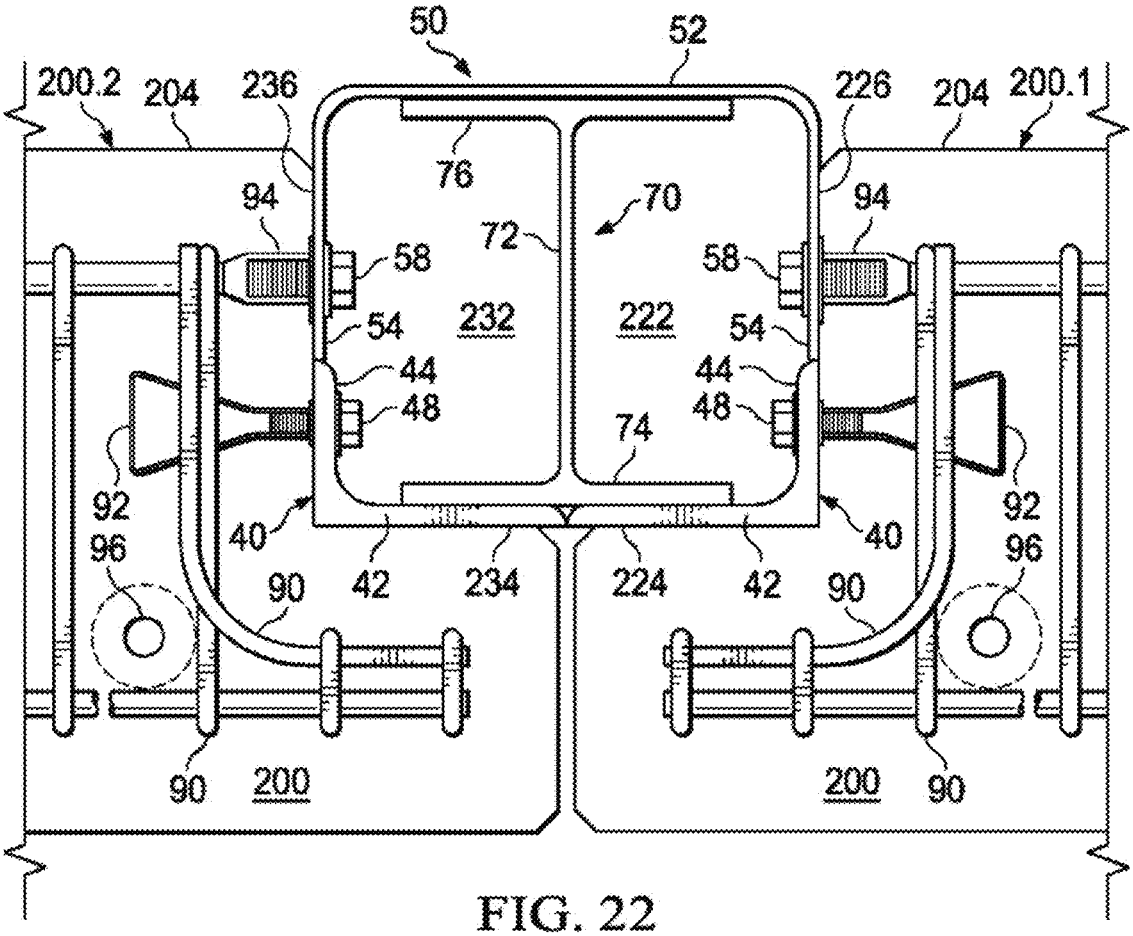
FIG. 22 is a top view of the brackets and connector embodiments of FIGS. 10 and 11, illustrated connecting adjacent crash panels to each other in accordance with an embodiment of the invention.

FIG. 22 is a top view of angle brackets 40 and strap connector 50 as connecting adjacent crash panels 200.1 and 200.2 around post 70 in the manner that is unique to the present invention. As best seen in this view (see also FIGS. 1-4), post 70 is located along a roadway to be barricaded.

Post 70 is oriented with first flange 74 facing a roadway to be barricaded. First crash panel 200.1 is positioned above a sound panel (See FIGS. 1-4) with first recess 222 on the right side of post 70. Second crash panel 200.2 is positioned adjacent to first crash panel 200.1 with second recess 232 of second crash panel 200.2 on the left side of post 70. In this position, angle brackets 40 of first and second crash panels 200.1 and 200.2 engaged first flange 74 of post 70.

Connection strap 50 is then positioned against second flange 76 of post 70. Strap fastener 58 secures one arm 54 of connection strap 50 to recess end 226 of first crash panel 200.1. Another strap fastener 58 secures the other arm 54 of connection strap 50 to recess end 236 of second crash panel 200.2. Base 52 of connection strap 50 surrounds second flange 76 of post 70 and thus secures first crash panel 200.1 and second crash panel 200.2 together around post 70.

In the embodiment illustrated, strap fastener 58 is threadedly connected to a strap insert 94. Strap insert 94 is precast into the concrete body of crash panel 200 and connected to the network of reinforcing steel members 90 within crash panel 200. The connections thus realized provide a superior resistance to dislocation of crash panels 200 and significantly enhanced protection of sound barrier elements 100. More specifically, displacement of any crash panel 200 results in a tensile distribution of the stress of the impact throughout the length of series connected crash panels 200.

As shown in FIG. 22, angle bracket 40 is located in each of first recess 222 of crash panel 200.1 and second recess 232 of adjacent crash panel 200.2. Angle bracket 40 is located at the intersection of recess front 224 and recess end 226 of first recess 222. Angle bracket 40 is located such that bracket front 42 is positioned against recess front 224 and bracket end 44 is positioned against recess end 226. Bracket fastener 48 secures angle bracket 40 to crash panel 200.1. In the embodiment illustrated, bracket fastener 48 is threadedly connected to a bracket insert 92. Bracket insert 92 may be precast into the concrete body of crash panel 200 and may be connected to the network of reinforcing steel members 90 within crash panel 200.

An angle bracket 40 is similarly located at the intersection of recess front 234 and recess end 236 of second recess 232 of adjacent crash panel 200.2 and connected in the same manner as angle bracket 40 is in first recess 222 of crash panel 200.1.

Angle brackets 40 function to provide an intermediate engagement with steel post 70. When trucks or other vehicles impact traffic barrier and soundwall system 1 and produce lateral loads into crash panel 200, the engagement between angle brackets 40 and post 70 minimizes damage to the concrete surfaces of crash panel 200.

To minimize damage resulting from engagement of concrete crash panel 200 with steel post 70, angle bracket 40 may be made of metal, such as steel. In another embodiment, angle bracket 40 is made of a compressible material such as a thermoplastic polymer. In another embodiment, angle bracket 40 is made of a high-density polyethylene (HDPE).

Cover inserts 96 may be precast into the first end 220 and second end 230 of the concrete body of crash panel 200 and may be connected to the network of reinforcing steel members 90 within crash panel 200. Cover inserts 96 intersect crash panel top 216 as seen in FIG. 19. Cover inserts 96 receive cover fasteners 278 in threaded connection to secure seam covers 270 to crash panel surface reliefs 250 of crash panels 200 as best seen in FIGS. 1, 6 and 24.

Figure 23:
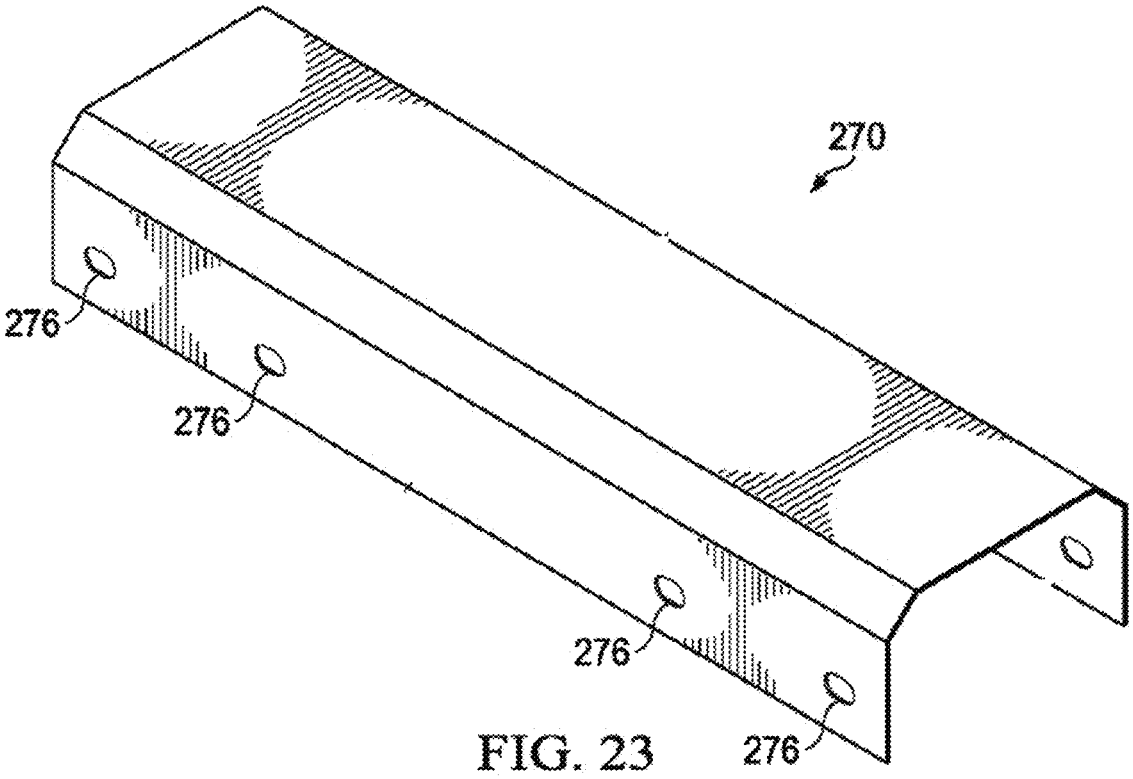
FIG. 23 is an isometric view of an embodiment of a seam cover for use between adjacent crash panels, as may be incorporated into the traffic barrier and soundwall system illustrated in FIG. 1.

FIG. 23 is an isometric view of an embodiment of a seam cover for use between adjacent crash panels, as may be incorporated into the traffic barrier and soundwall system illustrated in FIG. 1.

Figure 24:
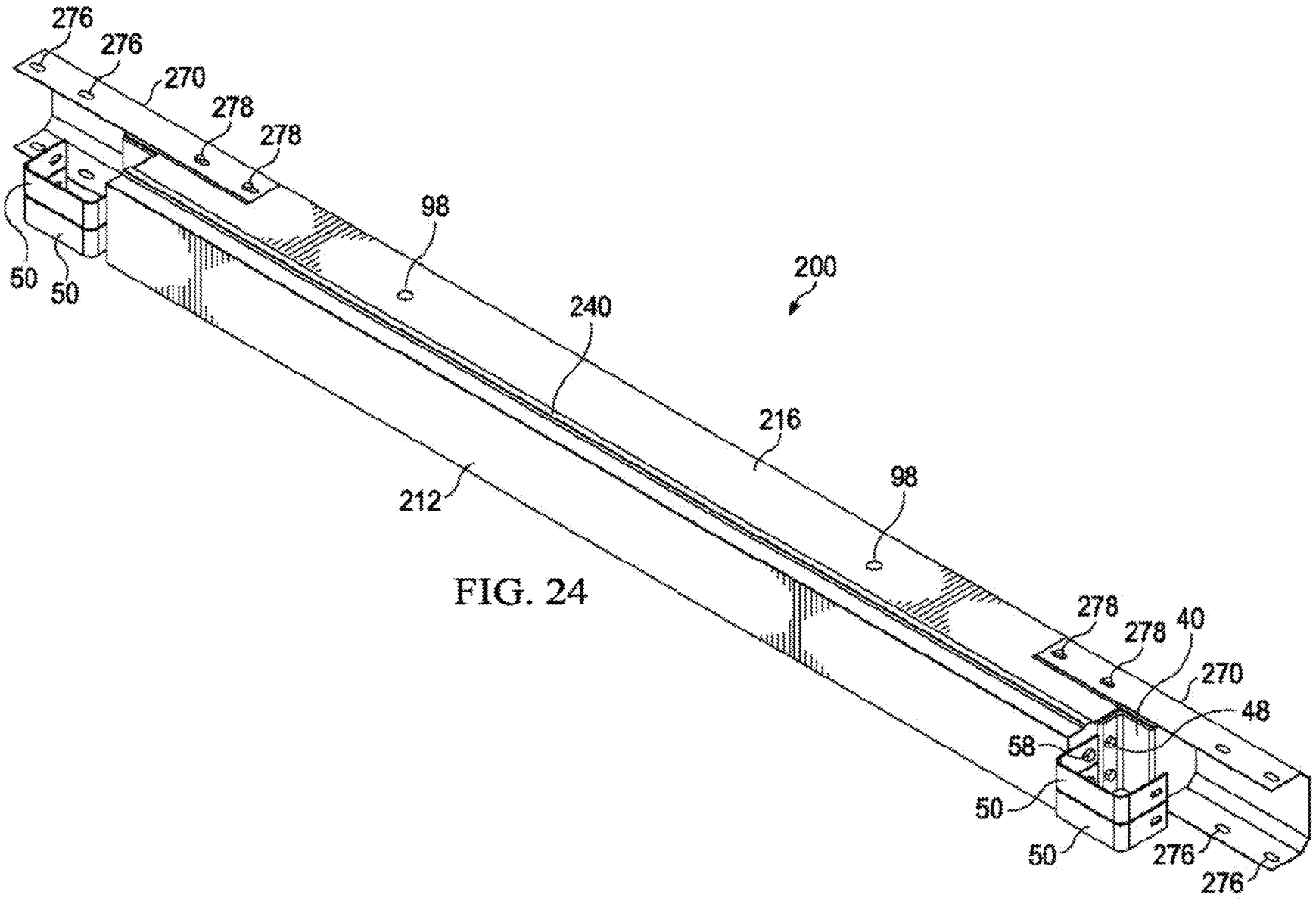
FIG. 24 is a top isometric view of an crash panel as may be incorporated into the traffic barrier and soundwall system illustrated in FIG. 1.

FIG. 24 is a top isometric view of a crash panel as may be incorporated into the traffic barrier and soundwall system illustrated in FIG. 1. As also seen in FIG. 6, a seam cover 270 is provided at the junction between adjacent crash panels. A plurality of orifices 276 is located on each seam cover 270 for receiving a cover fastener 278 for securing seam cover 270 to the ends of adjacent crash panels 200.

Figure 25:
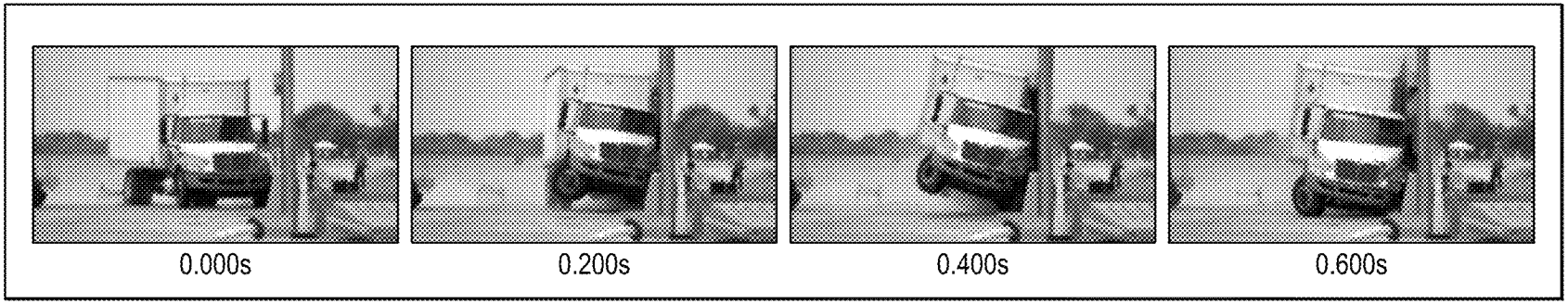
FIG. 25 is sequence of four crash test photographs taken in 0.20 second intervals illustrating the successful performance of the traffic barrier and soundwall system of the present invention.

FIG. 25 is sequence of four crash test photographs taken in 0.20 second intervals illustrating the successful performance of the traffic barrier and soundwall system 1 of the present invention. Traffic barrier and soundwall system 1 was successfully tested according to the safety-performance evaluation guidelines included in the American Association of State Highway and Transportation Officials (AASHTO), Manual for Assessing Safety Hardware (MASH).

Figure 26:
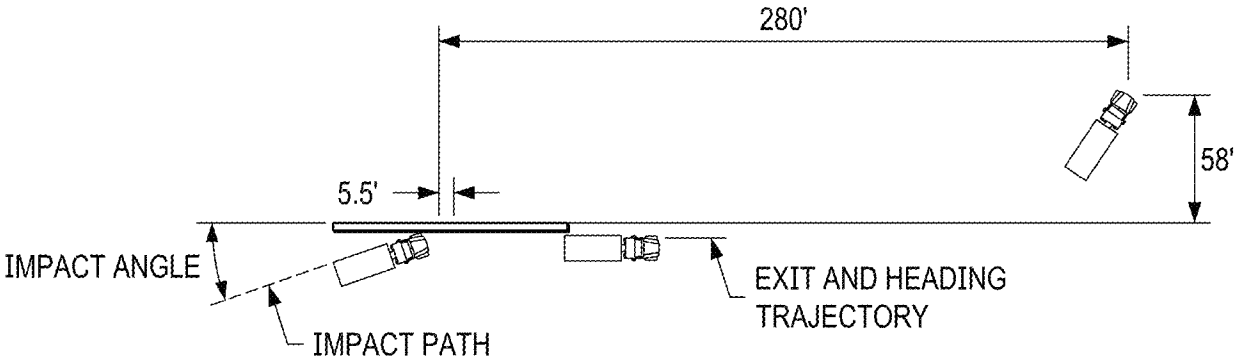
FIG. 26 is diagram of the crash test performed to which the photos of FIG. 25 apply.

FIG. 26 is diagram of the crash test performed to which the photos of FIG. 25 apply. The crash test was performed in accordance with MASH Test 4-12, which involves a 10000S vehicle weighing 22,000 lb (10000 kg) impacting the longitudinal barrier while traveling at 56 mi/h (90 km/h) and 15 degrees. Table 5.6 below summarizes the pertinent information from the crash test, in which traffic barrier and soundwall system 1 met the performance criteria for MASH Test 4-12.

FIG. 5.6. Summary of Results for MASH Test 4-12 on Proprietary Traffic Barrier with Inertial Crash Panel and Soundwall System.

| General Information | |
|---|---|
| Test Agency | Texas A&M Transportation Institute (TTI) |
| Test Standard Test No. | MASH Test 4-12 |
| TTI Test No. | 690902-PCL 10 |
| Test Date | 2020 Jul. 15 |
| Test Article | |
| Type | Longitudinal Barrier - Soundwall |
| Name | Proprietary Traffic Barrier with Inertial Crash Panel and Soundwal |
| Installation Length | 75 ft (22.86 m) |
| Material or Key Elements | Five 15 ft (4.562 m) long sections of concrete barrier, 3.3 ft (1 m) above pavement × 2.1 ft (0.648 m) wide at the base × 1.5 ft (0.46 m) at top, with Durisol ® soundwall panels. Five 15 ft (4.562 m) long sections of concrete inertial crash panels 129.5 in (3289 mm) above pavement. Six W10 × 33 (W250 × 49) × 24.8 Rt (7.56 m) steel posts at 15 ft (4.57 m). |
| Soil Type and Condition | Concrete footers in native clay sol |
| Test Vehicle | |
| Type/Designation | 10000S |
| Make and Model | 2012 International 4300 SUT |
| Curb | 13,490 lb (6119 kg) |
| Test Inertial | 22,420 lb (10170 kg) |
| Dummy | No dummy |
| Gross Static | 22,420 lb (10170 kg) |
| Impact Conditions | |
| Speed | 57.8 mi/h (93.0 km/h) |
| Angle | 14.9 degrees |
| Location/Orientation | 5.5 ft (1.7 m) upstream 2-3 |
| Impact Severity | 166 kip-ft (224 kJ) |
| Exit Conditions | |
| Speed | Remained in contact to end of barrier |
| Trajectory/Heading Angle | |

-continued

FIG. 5.6. Summary of Results for MASH Test 4-12 on Proprietary Traffic Barrier with Inertial Crash Panel and Soundwall System.

| Occupant Risk Values | |
|---|---|
| Longitudinal OIV | 6.6 ft/s (2.0 m/s) |
| Lateral OIV | 11.5 ft/s (3.5 m/s) |
| Longitudinal Ridedown | 3.5 g |
| Lateral Ridedown | 8.7 g |
| THIV | 4.1 m/s |
| ASI | 0.7 |
| Max. 0.050-s Average | |
| Longitudinal | −1.9 g |
| Lateral | 6.0 g |
| Vertical | −2.3 g |
| Post-impact Trajectory | |
| Stopping Distance | 280 ft downstream<br>58 ft twd field side |
| Vehicle Stability | |
| Maximum Yaw Angle | 14 degrees |
| Maximum Pitch Angle | 5 degrees |
| Maximum Roll Angle | 12 degrees |
| Vehicle Snagging | No |
| Vehicle Pocketing | No |

-continued

FIG. 5.6. Summary of Results for MASH Test 4-12 on Proprietary Traffic Barrier with Inertial Crash Panel and Soundwall System.

| Test Article Deflections | |
|---|---|
| Dynamic | 6.6 inches (167 mm) |
| Permanent | 1.0 inch (25 mm) |
| Working Width | 32.1 inches (815 mm) |
| Height of Working Width | 201.7 inches (5123 mm) |
| Vehicle Damage | |
| VDS | NA |
| CDC | NA |
| Max. Exterior Deformation | 14.0 inches (356 mm) |
| OCDI | NA |
| Max. Occupant Compartment Deformation | 6.5 inches (165 mm) |

Note:
OTV = Occupant Impact Velocity; THTV = Theoretical Head Impact Velocity; ASI = Acceleration Severity Index: NA = Not Applicable.

Table 6.1 provides the evaluation of the test data and demonstrates the success of traffic barrier and soundwall system 1 in actual MASH (Manual for Assessing Safety Hardware) testing vehicle weighing 22,000 lb (10000 kg) impacting the longitudinal barrier while traveling at 56 mi/h (90 km/h) and 15 degrees. As performed by the Texas A&M Transportation Institute.

TABLE 6.1

Performance Evaluation Summary for MASH Test 4-12 on Proprietary Traffic Barrier with Soundwall System.

| Test Agency: Texas A&M Transportation Institute<br>MASH Test 4-12 Evaluation Criteria | Test No.: 690902-PCL10<br>Test Results | Test Date: 2020 Jul. 15<br>Assessment |
|---|---|---|
| Structural Adequacy | | Pass |
| A. Test article should contain and redirect the vehicle or bring the vehicle to a controlled stop; the vehicle should not penetrate, underride, or override the installation although controlled lateral deflection of the test article is acceptable. | The proprietary Traffic Barrier with Soundwall System contained and redirected the 10000S vehicle. The vehicle did not penetrate, underride, override the installation. Maximum dynamic deflection during the test is 6.6 inches (167 mm). | |
| Occupant Risk | | Pass |
| D. Detached elements, fragments, or other debris from the test article should not penetrate or show potential for penetrating the occupant compartment, or present an undue hazard to other traffic, pedestrians, or personnel in a work zone. | No detached elements, fragments, or other debris were present to penetrate or show potential for penetrating the occupant compartment, or present hazard to others in the area. | |
| Deformations of, or intrusions into, the occupant compartment should not exceed limits set forth in Section 5.2.2 and Appendix E of MASH. | Maximum occupant compartiment deformation was 6.5 inches (165 mm) in the left kick panel floor pan area. | |
| G. It is preferable, although not essential, that the vehicle remain upright during and after collision. | The 10000S vehicle remained upright during and after the collision event. | Pass |

As seen from the test results, the unique features and connectivity of traffic barrier and soundwall system 1 disclosed herein successfully meet or exceed the stringent criteria of the MASH 4-12 Standard.

As used herein, the term "substantially" is intended for construction as meaning "more so than not." It will be understood by one of ordinary skill in the art that although described in primary geometric terms, conventional manufacturing and casting practices may employ chamfered, beveled or radius edges. As an example, only, and not as a limitation, precast concrete traffic barriers may have 15 mm×45° chamfers.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and, in a manner, consistent with the scope of the invention.

The invention claimed is:

1. A traffic barrier and soundwall system, comprising:

a plurality of flanged vertical posts having a central web and a first flange centered on an end of the web and a second flange centered on an opposite end of the web;

the posts oriented with the first flange facing a roadway;

a first traffic barrier located between a first and second post; a second traffic barrier located between the second and a third post;

a first crash panel located above the first traffic barrier, and extending between the first and second post;

a second crash panel located above the second traffic barrier, and extending between the second post and the third post;

each traffic barrier and crash panel comprising:

a front and an opposite back;

a first end and an opposite second end;

a top and a bottom;

a first recess located at the intersection of the back and the first end;

a second recess located at the intersection of the back and the second end; and, the first recess and second recess having a recess front and a recess end;

a U-shaped strap connector having a base and a pair of arms extending perpendicularly from the base, and having an orifice located on each arm;

a strap fastener connecting one arm of the strap connector to the first recess of the first traffic barrier;

a strap fastener connecting the other arm of the strap connector to the second recess of the second traffic barrier;

the base of the strap connector positioned beyond the second flange of the second post to secure the first traffic barrier to the second traffic barrier;

a second U-shaped strap connector having a base and a pair of arms extending perpendicularly from the base, and having an orifice located on each arm;

a strap fastener connecting one arm of the second U-shaped strap connector to the first crash panel and a strap fastener connecting the other arm of the second U-shaped strap connector to the second crash panel; and, the base of the second U-shaped strap connector positioned beyond the second flange of the second post to secure the first crash panel to the second crash panel.

2. The traffic barrier and soundwall system of claim 1, further comprising:

an L-shaped angle bracket having a bracket front and a bracket end;

the angle bracket located adjacent the recess front and recess end of each of the first and second recesses of the first and second traffic barriers;

a bracket fastener securing each angle bracket to the traffic barriers; and, the first and second traffic barriers positioned such that the bracket front in the first recess of the first traffic barrier and the bracket front in the second recess of the second traffic barrier are adjacent to the first flange of the second post.

3. The traffic and sound barrier section of claim 2, further comprising:

the angle bracket being made of steel.

4. The traffic and sound barrier section of claim 2, further comprising:

the angle bracket being made of a non-metallic compressible material.

5. The traffic and sound barrier section of claim 2, further comprising:

the angle bracket being made of a high-density polyethylene (HDPE).

6. The traffic barrier and soundwall system of claim 2, further comprising:

a bracket insert cast into the first traffic barrier to receive the bracket fastener in threaded connection.

7. The traffic barrier and soundwall system of claim 2, further comprising:

the first traffic barrier being precast concrete having a minimum compressive strength of 28 MPa (4000 psi).

8. The traffic barrier and soundwall system of claim 2, further comprising:

the first crash panel being precast concrete having a minimum compressive strength of 28 MPa (4000 psi).

9. The traffic barrier and soundwall system of claim 1, further comprising:

an L-shaped angle bracket having a bracket front and a bracket end;

the angle bracket located adjacent the recess front and recess end of each of the first and second recesses of the first and second crash panels;

a bracket fastener securing each angle bracket to the crash panels; and, the first and second crash panels positioned such that the bracket front in the first recess of the first crash panel and the bracket front in the second recess of the second crash panel are adjacent to the first flange of the second post.

10. The traffic barrier and soundwall system of claim 9, further comprising:

a bracket insert cast into the first crash panel to receive the bracket fastener in threaded connection.

11. The traffic barrier and soundwall system of claim 1, further comprising:

a first sound panel located on top of the first traffic barrier, and between the first post and the second post;

a second sound panel located on top of the first sound panel; and between the first post and the second post; and, the first crash panel located on top of the second sound panel.

12. The traffic barrier and soundwall system of claim 3, further comprising:

a third sound panel located on top of the first crash panel, and between the first post and the second post.

13. The traffic barrier and soundwall system of claim 11, further comprising:

the crash panels further comprising:

an elongated slot extending along the bottom; and, an elongated ridge extending along the top;

the sound panels further comprising:

an elongated slot extending along the bottom; and, an elongated ridge extending along the top; and, wherein the slots and ridges of vertically adjacent sound and crash panels are nested together.

14. The traffic barrier and soundwall system of claim 1, further comprising:

a seam cover extending between the front of the first crash panel and the front of the second crash panel; and, wherein the seam cover allows the tops of vehicles that engage the crash panels to slide across the intersections of crash panels without impacting the ends of the crash panels.

15. The traffic barrier and soundwall system of claim 1, the crash panels further comprising:

a pair of lifting anchors for raising the crash panels into position.

16. The traffic barrier and soundwall system of claim 1, further comprising:

the crash panels made of concrete having a test strength of at least 4000 psi.

17. The traffic and sound barrier section of claim 1, further comprising:

the first traffic barrier having an internal network of reinforcing steel.

18. The traffic and sound barrier section of claim 1, further comprising:

the first crash panel having an internal network of reinforcing steel.

19. The traffic barrier and soundwall system of claim 1, further comprising:

the strap fastener located proximate the top of the first traffic barrier to permit access for rotating the strap fastener to make its connection to the first traffic barrier.

20. The traffic barrier and soundwall system of claim 1, further comprising:

a strap insert cast into the first traffic barrier to receive the strap fastener in threaded connection.

21. The traffic barrier and soundwall system of claim 1, further comprising:

a strap insert cast into the first crash panel to receive the strap fastener in threaded connection.

22. The traffic barrier and soundwall system of claim 1, further comprising:

a subterranean footer surrounding the post below ground level.

23. The traffic barrier and soundwall system of claim 1, further comprising:

the first, second, and third posts being a wide-flanged vertical post being a metric W250×49 [US Customary W10×33] steel post.

* * * * *